United States Patent [19]

Lisa et al.

[11] Patent Number: 4,843,772

[45] Date of Patent: Jul. 4, 1989

[54] MARA BLOCK

[76] Inventors: Robert W. Lisa, 133 Dix Hwy., Dix Hills, N.Y. 11746; George Spector, 233 Broadway, Rm 3815, New York, N.Y. 10007

[21] Appl. No.: 113,497

[22] Filed: Oct. 28, 1987

[51] Int. Cl.[4] ..... E04B 5/46

[52] U.S. Cl. ..... 52/308; 52/475

[58] Field of Search ..... 57/474, 475, 477, 306, 57/307, 308, 591

[56] References Cited

U.S. PATENT DOCUMENTS

| | | | |
|---|---|---|---|
| 1,852,715 | 4/1932 | Greenbaum | 52/591 X |
| 1,960,160 | 5/1934 | Lousa | 52/308 X |
| 3,302,343 | 2/1967 | Bear | 52/475 X |
| 3,591,992 | 7/1971 | Pawlicki | 52/475 X |
| 4,058,943 | 11/1977 | Sturgill | 52/477 X |

*Primary Examiner*—David A. Scherbel
*Assistant Examiner*—Creighton Smith

[57] ABSTRACT

A prefabricated glass block partition and window unit is provided and consists of a frame and a plurality of block strips simulating a plurality of individual glass blocks vertically positioned one upon the other. When frame and block strips are assembled together they can be used as a glass block partition or a glass block window.

1 Claim, 1 Drawing Sheet

MARA BLOCK

BACKGROUND OF THE INVENTION

The instant invention relates generally to building panel structures and more specifically it relates to a prefabricated glass block partition and window unit.

Numerous building panel structures have been provided in prior art that are adapted to be assembled at the building site. For example U.S. Pat. Nos. 3,343,314; 3,762,109 and 4,208,848 all are illustrative of such prior art. While these units may be suitable for the particular purpose to which they address, they would not be as suitable for the purposes of the present invention as heretofore described.

SUMMARY OF THE INVENTION

A primary object of the present invention is to provide a prefabricated glass block partition and window unit that will overcome the shortcomings of the prior art devices.

Another object is to provide a prefabricated glass block partition and window unit whereby the average homeowner can install the unit in a building in a matter of hours with just a screwdriver and a hacksaw.

An additional object is to provide a prefabricated glass block partition and window unit whereby the unit is adjustable to fit various sized areas in height and width.

A further object is to provide a prefabricated glass block partition and window unit that is simple and easy to use.

A still further object is to provide a prefabricated glass block partition and window unit that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
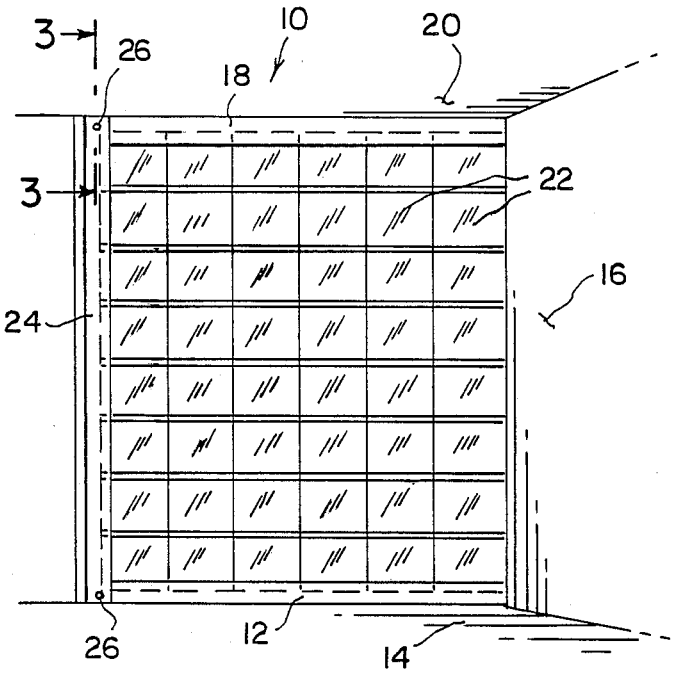
FIG. 1 is a perspective view of the invention installed in place as a partition.
Figure 2:
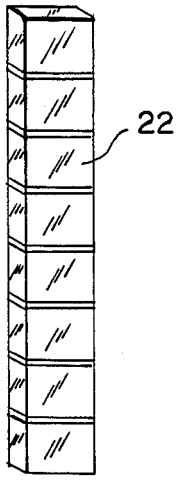
FIG. 2 is a perspective view of just one of the block strips.
Figure 3:
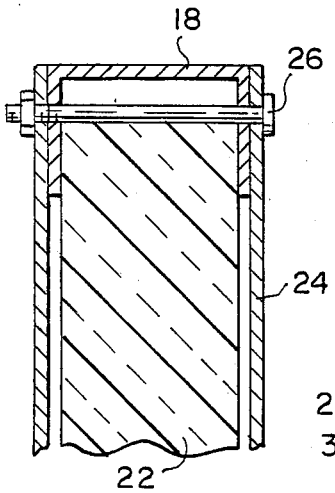
FIG. 3 is an enlarged cross sectional view taken along line 3—3 in FIG. 1 showing a fastener.

Turning now descriptively to the drawings, in which similar reference characters denote similar elements throughout the several views, FIG. 1 illustrates a prefabricated glass block partition 10, consisting of a first frame member 12, U-shaped in cross-section, mounted to a floor 14 and extending outwardly away from an existing wall 16. A second frame member 18 also U-shaped in cross section is mounted to a ceiling 20 and extends outwardly away from the existing wall 16 directly above the first frame member 12. A plurality of blocks strips 22 (see FIG. 2) are provided in which each of the block strips 22 simulates a plurality of individual glass blocks vertically positioned one upon the other. The block strips 22 are vertically positioned side by side between the first and second frame members 12 and 18 to form the partition 10. A third frame member 24, also U-shaped in cross section extends vertically between ends of the first and second frame members 12 and 18 and against end of last of the block strips 22. A pair of fasteners 26 (see FIG. 3) such as nuts and bolts or cotter pins, are also used in which one of the fasteners 26 extends through lower end of the third frame member 24 and the first frame member 12 while other of the fasteners 26 extends through upper end of the third frame member 24 and end of the second frame member 18.

Figure 4:
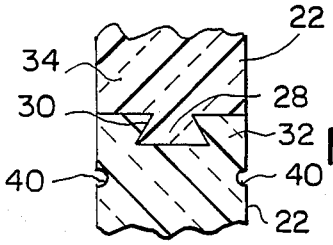
FIG. 4 is a cross sectional view of a modification in which top portion of block strip is tongue and grooved to an additional block strip to increase its height thereof.

FIG. 4 shows a modification in which a tongue 28 and groove 30 are into top and bottom portions 32 and 34 of the block strips 22 so that additional block strips 22 can be assembled thereto to increase height thereof.

Figure 6:
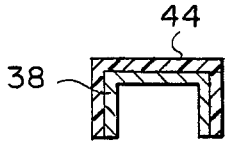
FIG. 6 is a cross sectional view taken along line 6—6 in FIG. 5 showing the plastic cover in greater detail.
Figure 5:
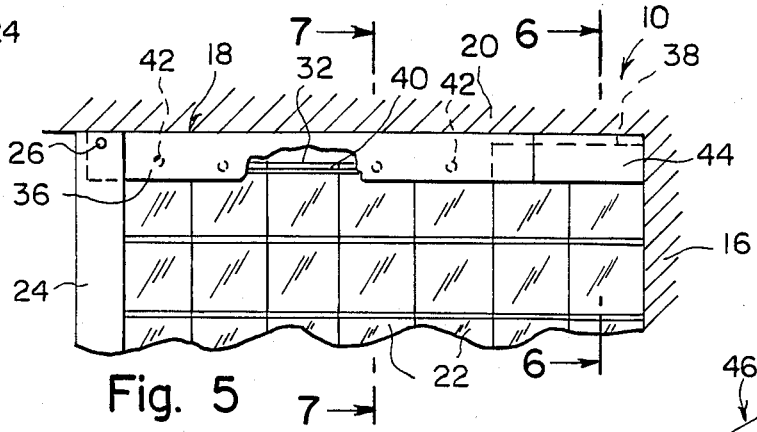
FIG. 5 is a front view with parts broken away showing an adjustable top frame member.
Figure 7:
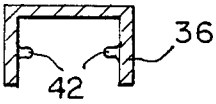
FIG. 7 is a cross sectional view taken along line 7—7 in FIG. 5 showing the top frame member having detents for holding each block strip stationary therein.

In FIGS. 5, 6 and 7 the second frame member 18 is segmented into two portions 36 and 38 so as to be adjustable for increasing length of the partition 10. One of the two portions 38 is smaller than other portion 36 and fits into longer portion 36 thereof. Each of the block strips 22 has two horizontal slots 40, each being formed in one side near the top portion 32 thereof. The longer portion 36 of the second frame member 18 has two rows of a plurality of detents 42 formed within each side so as to fit within the two horizontal slots 40 in each of the block strips 22 thus holding each of the block strips stationary therein. A cover 44 is of a size to fit over the small portion 38 of the second frame member 18 to make the second frame member look uniform in appearance. The first frame member 12 (not shown) has the same configuration as the second frame member 18.

Figure 8:
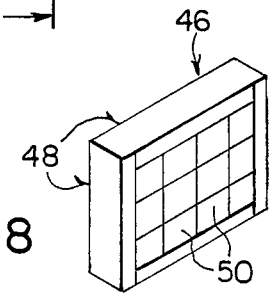
FIG. 8 is a perspective view of the block strips being used for a window unit.

A prefabricated glass window unit 46 is shown in FIG. 8 which consists of a four sided window frame assembly 48 being U-shaped in cross section to be assembled and mounted into a window opening in a wall (not shown). A plurality of block strips 50 are utilized. Each of the block strips 50 simulate a plurality of individual glass blocks vertically positioned one upon the other. The block strips 50 are vertically positioned side by side within the window frame assembly 48 to form the window unit 46 so as to be disposed into the window opening in the wall. The block strips 50 are identical to the block strips 22 but are used for a window unit 46 instead of the partition 10.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A prefabricated glass block partition which comprises:

(a) a first frame member, U-shaped in cross section, mounted to a floor and extending outwardly away from an existing wall;

(b) a second frame member, U-shaped in cross section, mounted to a ceiling and extending outwardly away from the existing wall directly above said first frame member;

(c) a plurality of block strips, each of said block strips simulating a plurality of individual glass blocks vertically positioned one upon the other, said block strips vertically positioned side by side between said first and second frame members to form said partition;

(d) a third frame member, U-shaped in cross section extending vertically between ends of said first and second frame members and against end of last of said block strips;

(e) a pair of fasteners, in which one said fastener extends through lower end of said third frame member and end of said first frame member while other of said fasteners extends through upper end of said third frame member and end of said second frame member;

(f) a tongue and groove formed into top and bottom portions of said block strips so that additional block strips can be assembled thereto to increase height thereof;

(g) said second frame member being segmented into two portions so as to be adjustable for increasing length of said partition, one of said two portions being smaller than other said portion and fits into longer portion thereof;

(h) each of said block strips having two horizontal slots each being formed on one side near the top portion thereof;

(i) said longer portion of said second frame member having two rows of a plurality of detents formed within each side so as to fit within the two horizontal slots in each of said block strips thus holding each of said block strips stationary therein; and (j) a cover being of a size to fit over said smaller portion of said second frame member to make said second frame member look uniform in appearance.

* * * * *